US006458260B2

(12) United States Patent
Nemelka

(10) Patent No.: US 6,458,260 B2
(45) Date of Patent: Oct. 1, 2002

(54) METHODS OF FORMING A FACE PLATE ASSEMBLY OF A COLOR DISPLAY

(75) Inventor: Jefferson O. Nemelka, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 09/760,191

(22) Filed: Jan. 12, 2001

Related U.S. Application Data

(62) Division of application No. 09/398,835, filed on Sep. 16, 1999, which is a division of application No. 09/096,365, filed on Jun. 11, 1998.

(51) Int. Cl.[7] ..... C25D 15/00; C25D 13/06; C08F 2/58; C23C 28/00

(52) U.S. Cl. ..... 204/485; 204/484; 204/489; 204/483; 204/486; 204/471

(58) Field of Search ..... 204/471, 483, 204/484, 485, 486, 489, 492

(56) References Cited

U.S. PATENT DOCUMENTS

| | | | |
|---|---|---|---|
| 3,681,223 | A | 8/1972 | Gupton |
| 3,858,083 | A | 12/1974 | Rehkopf et al. |
| 3,904,502 | A | 9/1975 | Phillips |
| 4,251,610 | A | 2/1981 | Haven et al. |
| 4,751,172 | A | 6/1988 | Rodgriguez et al. |
| 4,891,110 | A | 1/1990 | Libman et al. |
| 5,372,902 | A | 12/1994 | Yamashita et al. |
| 5,399,449 | A | 3/1995 | Tanimoto et al. |
| 5,527,648 | A | 6/1996 | Otsuki et al. |
| 5,582,703 | A | 12/1996 | Sluzky et al. |
| 5,871,873 | A | 2/1999 | Van Doorn et al. |
| 6,046,539 | A | 4/2000 | Haven |

OTHER PUBLICATIONS

Kang, Sang Won et al., "Photolithographic Patterning of Phosphors Screen by Electrophoretic Deposition for Field Emission Display", *Technical Digest of IVMC97 Kyongju*, 1997.

Siracuse, Jean A. et al., "The Adhesive Agent in Cataphoretically Coated Phosphor Screens", *Journal of the Electrochemical Society*, vol. 137, No. 1, Jan. 1990.

Hong, J. P. et al., Optimization and Analysis of Low Voltage Phosphors Deposited Electrophoretically for the FED Applications, *Technical Digest of IVMC97 Kyongju*, 1997.

*Primary Examiner*—Nam Nguyen
*Assistant Examiner*—Thao Tran
(74) *Attorney, Agent, or Firm*—Wells St. John P.S.

(57) ABSTRACT

Methods of forming face plate assemblies are described. In one implementation, a substrate is patterned with photoresist and a first phosphor-comprising material is formed over first surface areas of the substrate. The photoresist is stripped leaving some of the first phosphor-comprising material over substrate areas other than the first areas. Photoresist is again formed over the substrate and processed to expose second substrate areas which are different from the first substrate areas. In a preferred aspect, processing the photoresist comprises using a heated aqueous developing solution comprising an acid, e.g. lactic acid, effective to dislodge and remove first phosphor-comprising material from beneath the developed photoresist.

25 Claims, 13 Drawing Sheets

METHODS OF FORMING A FACE PLATE ASSEMBLY OF A COLOR DISPLAY

RELATED PATENT DATA

This patent resulted from a divisional application U.S. Pat application Ser. No. 09/398,835, which was filed of Sep. 16, 1999, which resulted from a divisional application of U.S. Pat application Ser. No. 9/096,365, which was filed on Jun. 11, 1998.

TECHNICAL FIELD

The present invention relates to methods of forming a face plate assembly of a color display.

BACKGROUND OF THE INVENTION

Field emission displays and cathode ray tubes are types of color displays which can function by having a layer of phosphor-comprising material applied on an internal surface of a face plate known as an anode, cathodeluminescent screen, display screen, or display electrode. Color displays typically include three different types of phosphor, namely red, green, and blue (RGB), which, when excited in various combinations, produce colors for presentation through the face plate of the display. The phosphor-comprising material is typically oriented or arranged in a series of pixels. Pixels are typically discrete areas of phosphor-comprising material formed on the internal surface of the face plate.

A technique by which such areas are provided on a face plate involves the use of photolithographic techniques to pattern the phosphor-comprising material. Typically, a face-plate will be coated with a thin layer of conductive material, generally Indium Tin Oxide (ITO). This conductive layer of material is coated with a layer of photoresist, which in turn, is used to pattern phosphor-comprising material into a color array of pixels. It may also serve for patterning black matrix material into a pixel pattern. Black matrix material is used in order to give greater contrast in color displays. Pixels, or holes, will be opened up in the photoresist using photolithographic techniques, thereby exposing distinct regions of the conductive material. The photolithographic techniques used to open the pixels or holes in the photoresist typically involve the use of developer solutions. For negative resists, developer solutions selectively dissolve and remove regions of the photoresist that have not been exposed to radiation actinic to the photoresist used. The black matrix and phosphor-comprising materials can then be electrophoretically deposited into the holes opened in the photoresist. The conductive layer is used as an electrode for depositing phosphor-comprising materials through electrophoresis. Electrophoresis, or electrophoretic deposition, in simply the migration of charged particles through a solution under the influence of an applied electric field applied by immersing two electrodes in the solution. Exemplary methods of depositing black matrix material and phosphor-comprising material are described in U.S. Pat. No. 4,891,110, the disclosure of which is incorporated by reference. Exemplary color displays are described in U.S. Pat. Nos. 5,712,534, 5,705,079, 5,697,825 and 5,688,438, the disclosures of which are incorporated by reference.

Photolithographic color patterning of a display typically involves the use of incident radiation, photomasks, and wet-chemical developers to selectively expose various pixels for deposition of black matrix material and different colors of phosphor-comprising material therein. Despite the use of these developers, electrophoretic deposition of powdered materials such as manganese carbonate and phosphor-comprising material can result in trace deposits undesirably remaining over adjacent areas or pixels. Such trace deposits can result in black spots and color cross-contamination with undesired color phosphor remaining in adjacent pixels dedicated to other colors, thus leading to color bleed and a less desirable display.

This invention arose out of concerns associated with improving the methods by which phosphor-comprising material is formed over face plates of color displays. This invention also arose out of concerns associated with providing improved color displays.

SUMMARY OF THE INVENTION

Methods of forming face plate assemblies are described. In one implementation, a substrate is patterned with photoresist and a first phosphor-comprising material is formed over first surface areas of the substrate. The photoresist is stripped leaving some of the first phosphor-comprising material over substrate areas other than the first areas. Photoresist is again formed over the substrate and processed to expose second substrate areas which are different from the first substrate areas. In a preferred aspect, processing the photoresist comprises using a heated aqueous developing solution comprising an acid, e.g. lactic acid, effective to dislodge and remove first phosphor-comprising material from beneath the developed photoresist. A second phosphor-comprising material is formed over the substrate and the exposed second areas, with trace deposits being left over other substrate areas. The photoresist is subsequently stripped leaving some of the second phosphor-comprising material over substrate areas other than the first and second areas. Photoresist is again formed over the substrate and processed to expose third substrate areas which are different from the first and second areas. In a preferred aspect, processing the photoresist comprises using a heated aqueous developing solution comprising an acid, e.g. lactic acid, effective to dislodge and remove first and second phosphor-comprising material from beneath the removed photoresist. A third phosphor-comprising material is formed over the substrate and the exposed third areas.

BRIEF DESCRIPTION OF THE DRAWINGS

Preferred embodiments of the invention are described below with reference to the following accompanying drawings.

FIG. 6 is a view of the FIG. 5 substrate at a different processing step.

FIG. 7 is a view of the FIG. 6 substrate at a different processing step.

FIG. 10 is a view of the FIG. 9 substrate at a different processing step.

FIG. 13 is a view of the FIG. 12 substrate at a different processing step.

FIG. 14 is a view of the FIG. 13 substrate at a different processing step.

FIG. 15 is a view of the FIG. 14 substrate at a different processing step.

FIG. 16 is a view of the FIG. 15 substrate at a different processing step.

FIG. 17 is a view of the FIG. 16 substrate at a different processing step.

FIG. 18 is a view of the FIG. 17 substrate at a different processing step.

FIG. 19 is a view of the FIG. 18 substrate at a different processing step.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
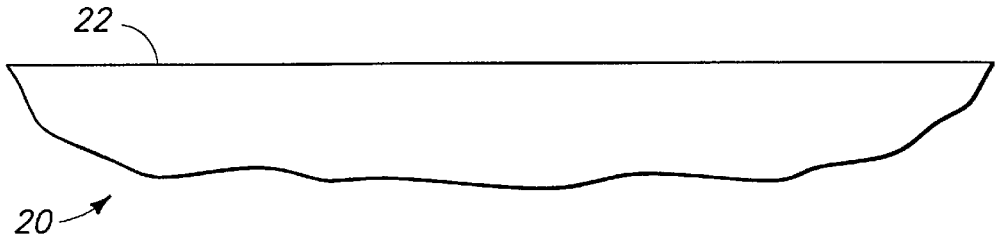
FIG. 1 is a diagrammatic sectional view of a substrate comprising a portion of a face plate assembly of a color display.

Referring to FIG. 1, a substrate is shown generally at 20 and comprises a portion of a face plate assembly of a color display. Substrate 20 includes an outer surface 22.

Figure 2:
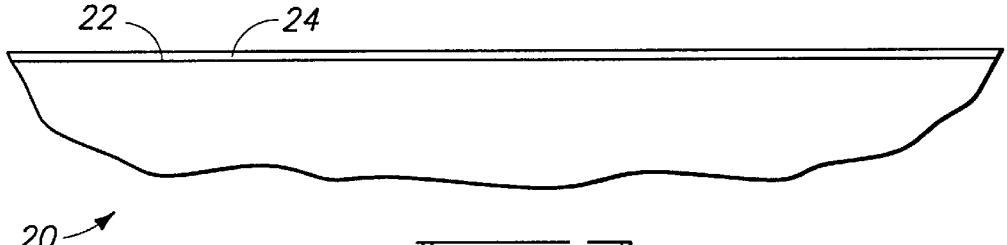
FIG. 2 is a view of the FIG. 1 substrate at a different processing step.

Referring to FIG. 2, a layer 24 is formed over surface 22 and comprises a conductive material such as indium tin oxide.

Figure 3:
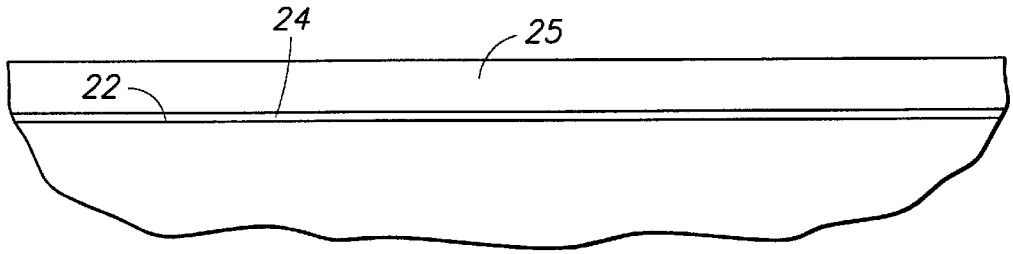
FIG. 3 is a view of the FIG. 2 substrate at a different processing step.

Referring to FIG. 3, a layer 25 is formed over substrate 20 and comprises a masking material such as photoresist.

Figure 4:
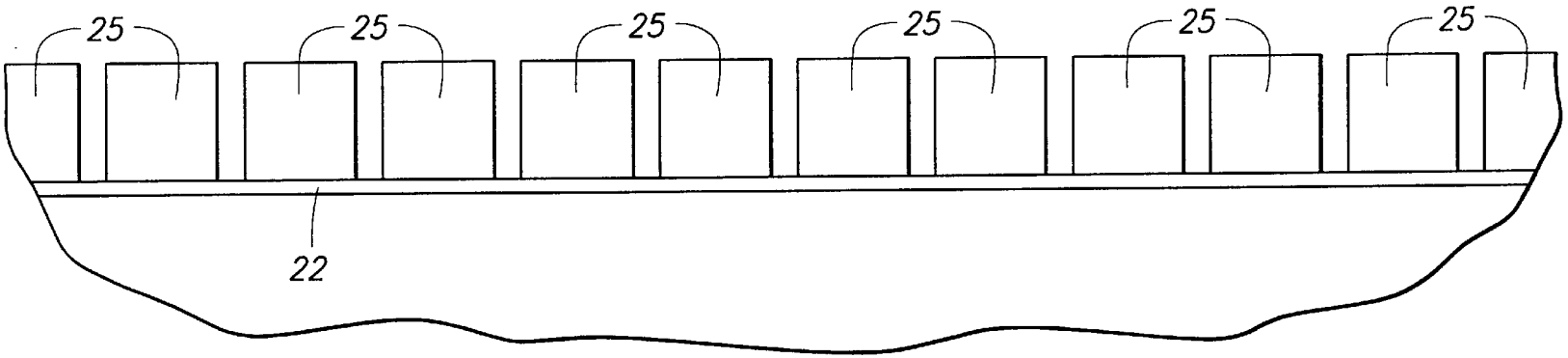
FIG. 4 is an enlarged view of the FIG. 3 substrate at a different processing step.

Referring to FIG. 4, layer 25 is patterned to define a plurality of openings (not specifically designated) over the substrate.

Figure 5:
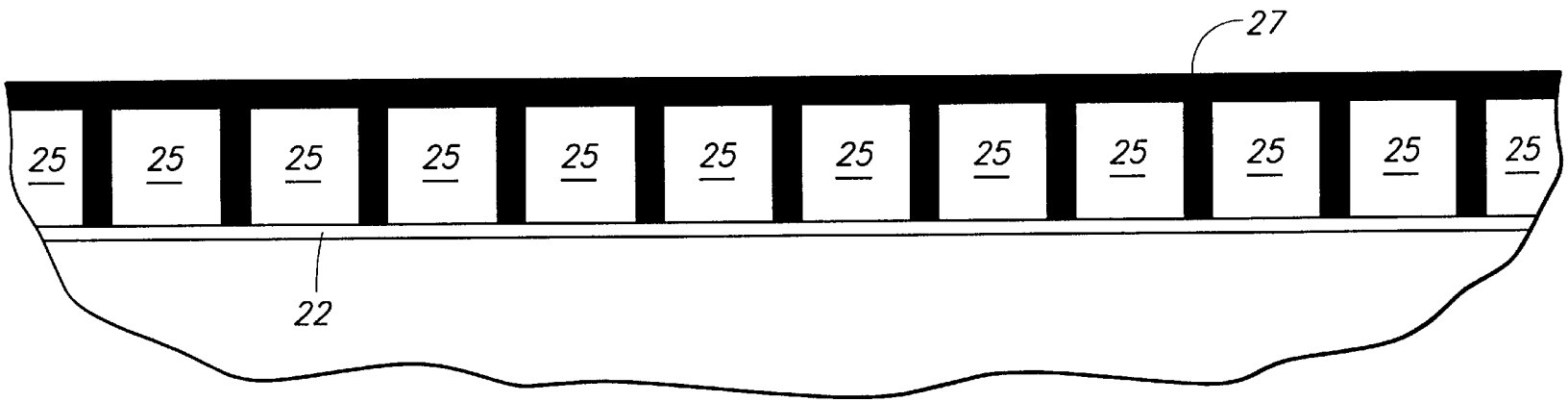
FIG. 5 is a view of the FIG. 4 substrate at a different processing step.

Referring to FIG. 5, black matrix material 27 is formed over the substrate and within the openings in layer 25.

Referring to FIG. 6, layer 25 is removed and leaves the deposited black matrix material over the substrate. Such material defines substrate areas over which phosphor-comprising material is to be deposited.

Referring to FIG. 7, a layer 26 is formed over substrate 20 and comprises a masking material such as photoresist. While positive photoresists can be used, negative photoresists such as polyvinyl alcohol are preferred.

Figure 8:
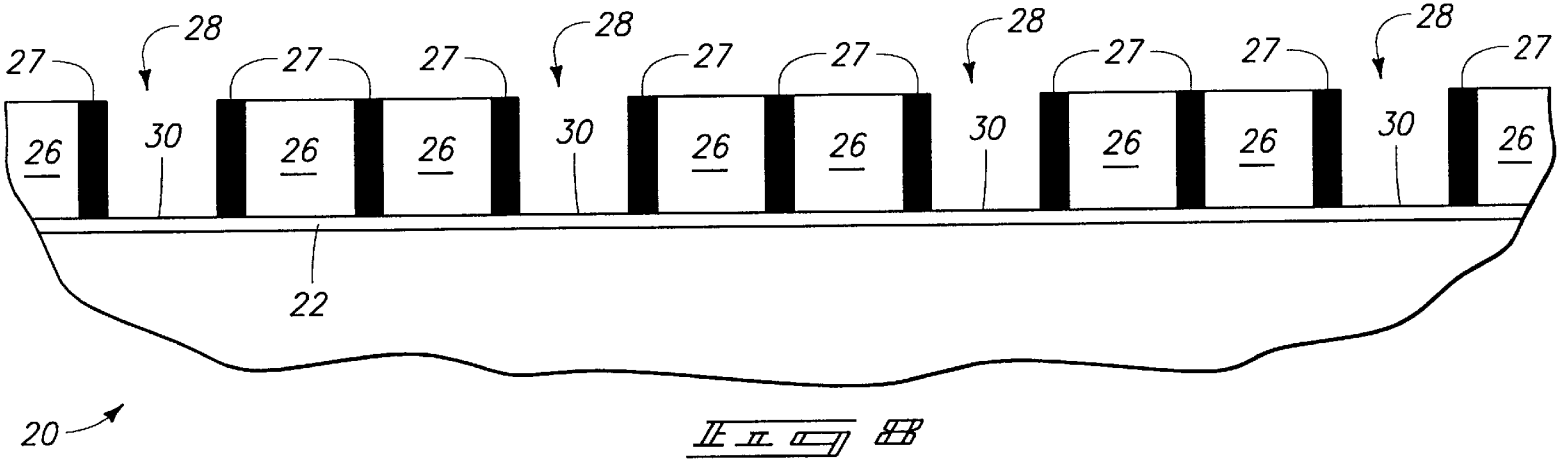
FIG. 8 is a view of the FIG. 7 substrate at a different processing step.

Referring to FIG. 8, layer 26 is patterned to define a first plurality of openings 28 over first substrate areas 30.

Figure 9:
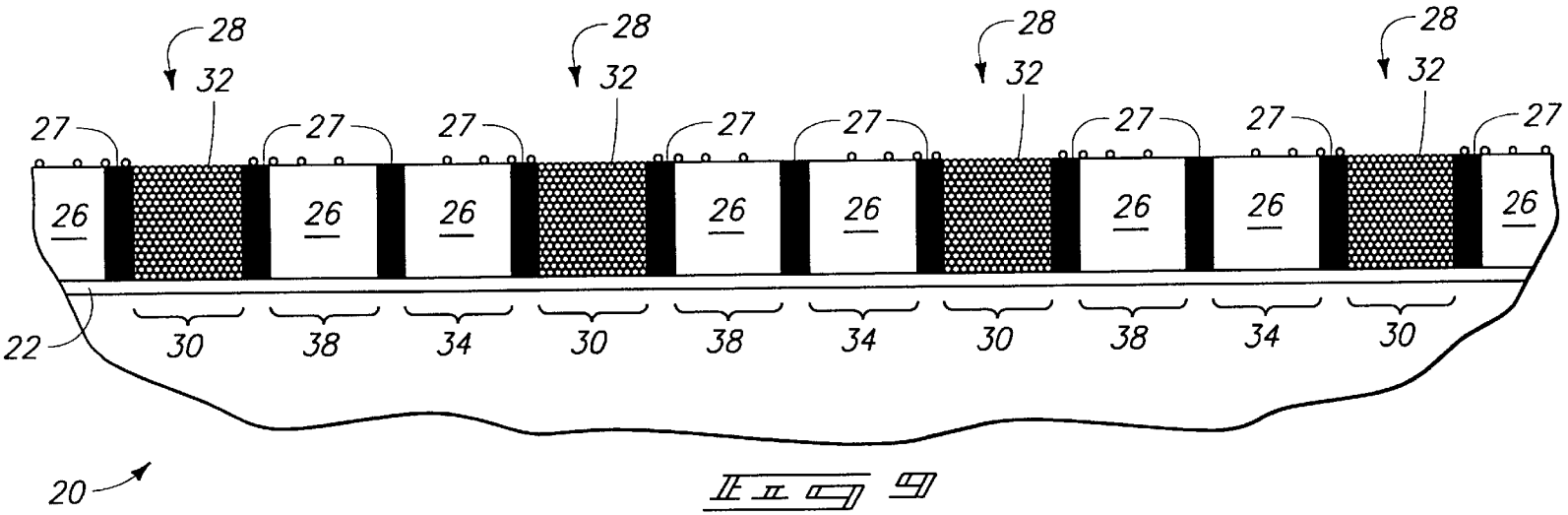
FIG. 9 is a view of the FIG. 8 substrate at a different processing step.
Figure 11:
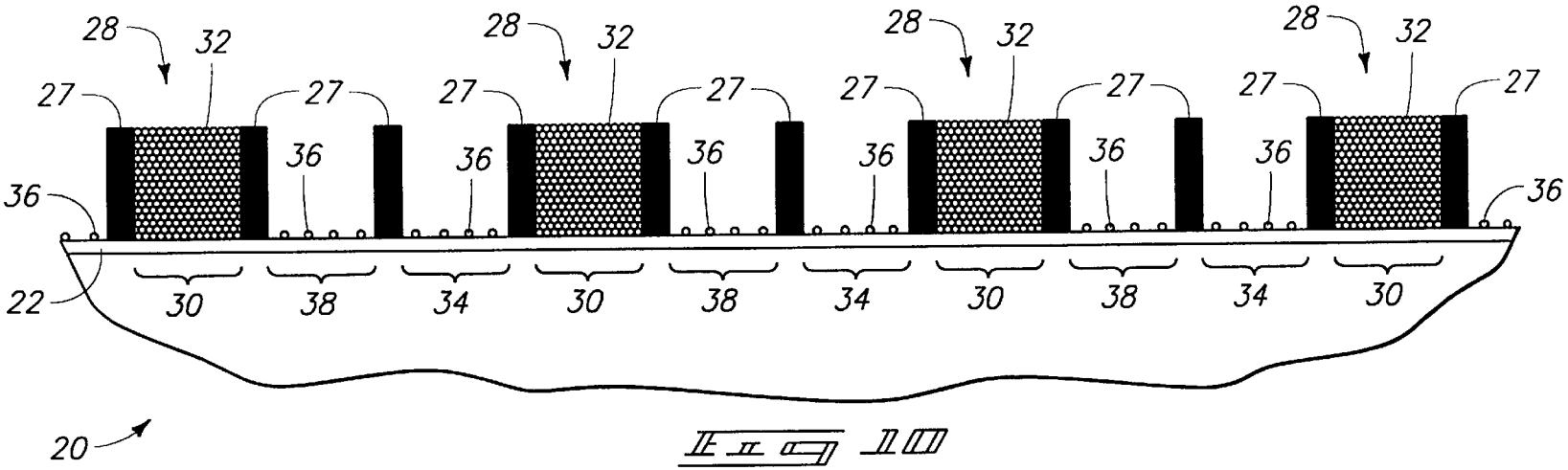
Figure 12:
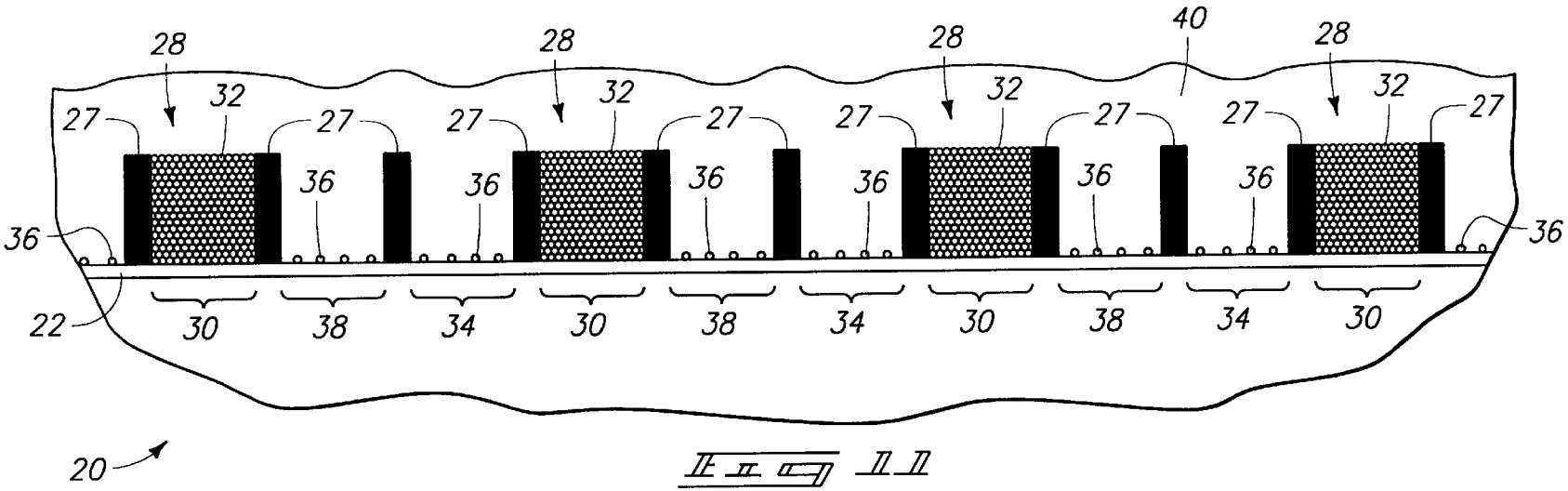
Figure 12:
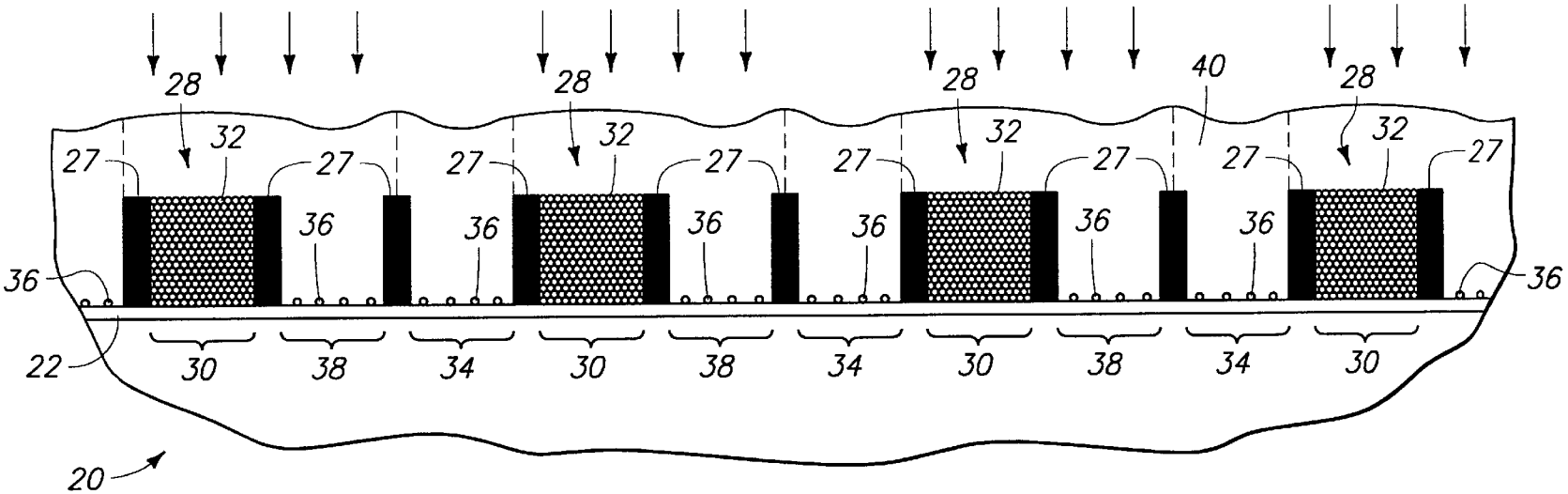
Figure 11:
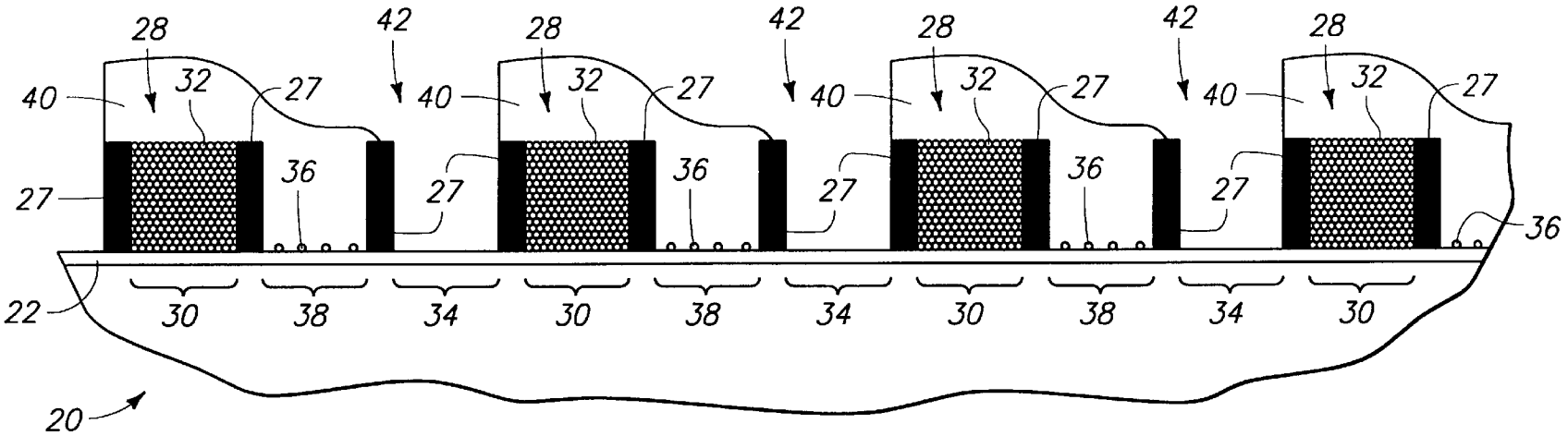
Figure 11:
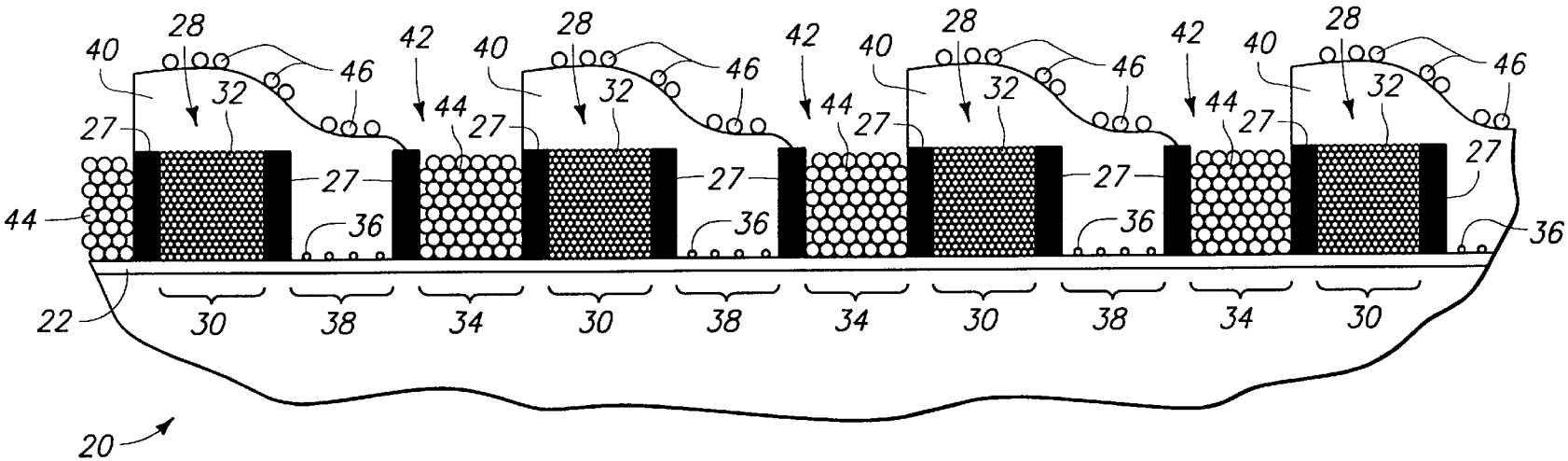
Figure 11:
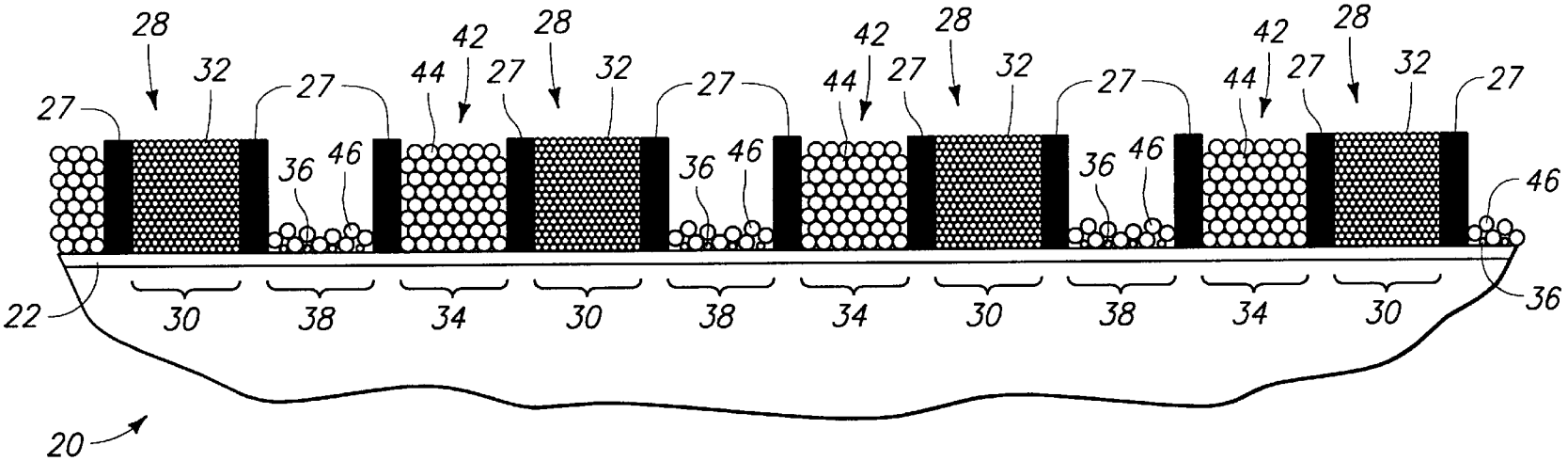
Figure 11:
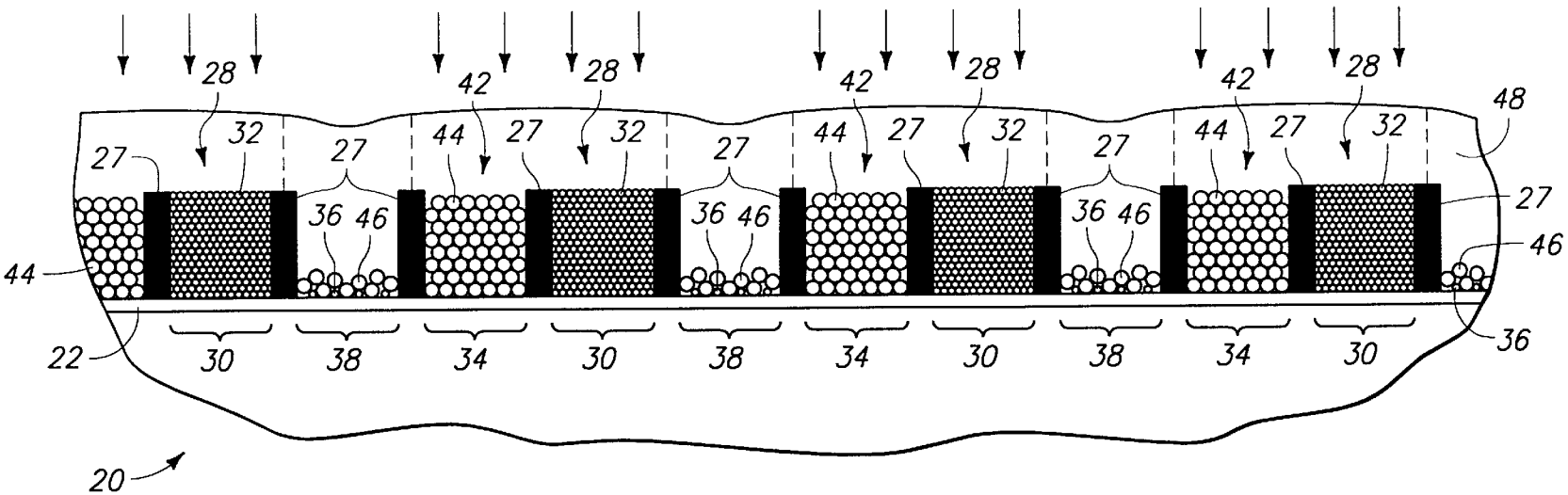
Figure 11:
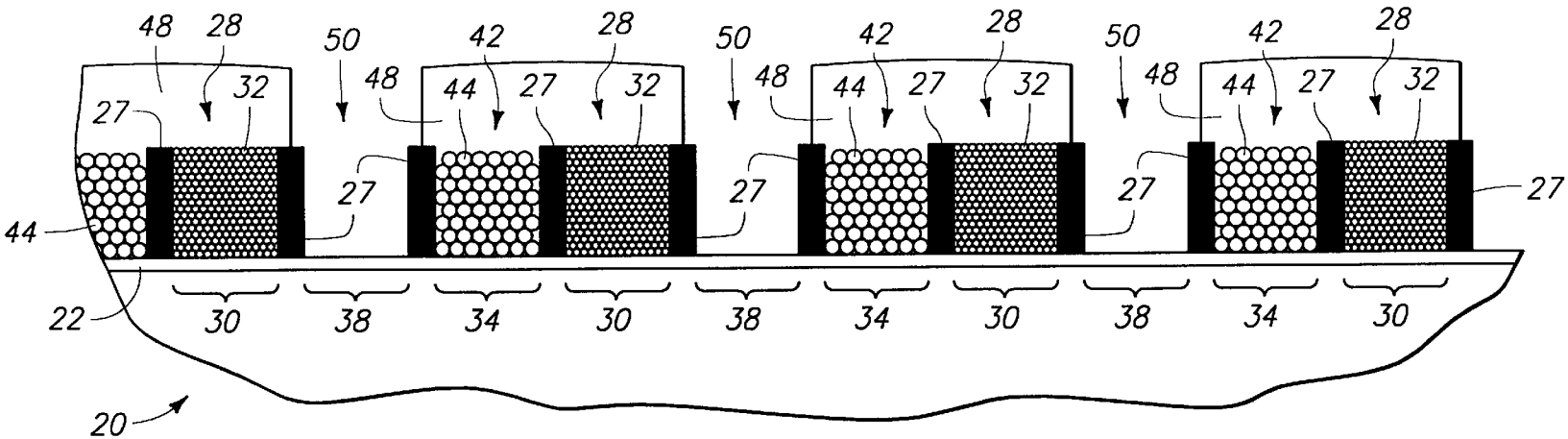
Figure 11B:
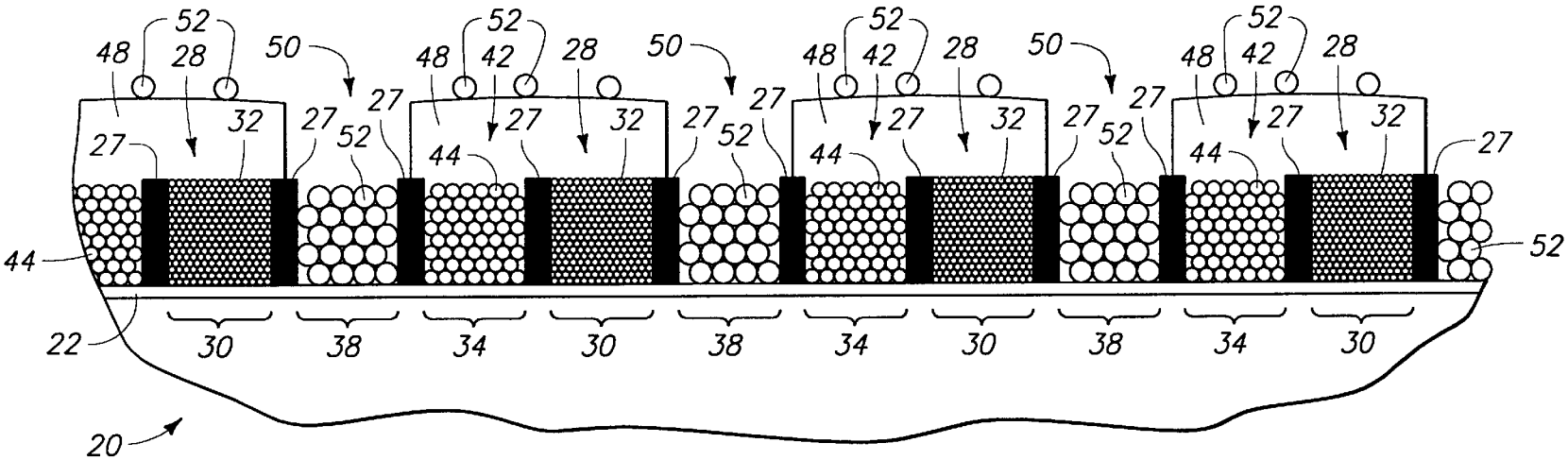
Figure 11:
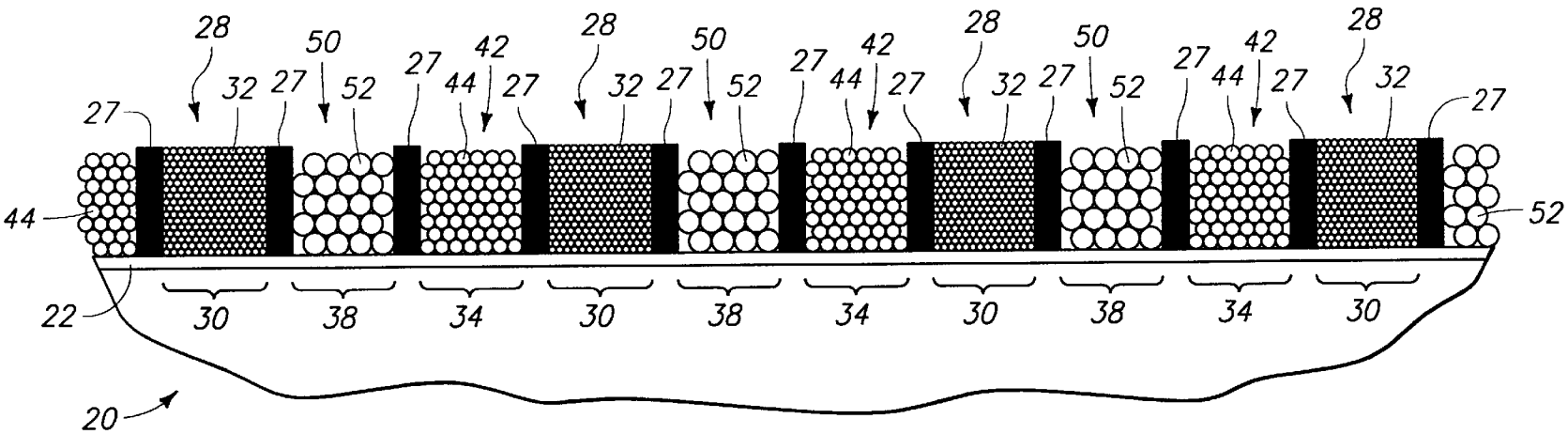

Referring to FIG. 9, a first phosphor-comprising material 32 is formed over the substrate and within first openings 28 over first substrate areas 30. Phosphor-comprising material 32 is also formed in trace amounts over patterned masking layer 26 and second and third substrate areas 34, 38. Phosphor-comprising material 32 is preferably electrophoretically deposited over first substrate areas 30. Generally, an electrophoretic solution is made up of a nonaqueous liquid, such as isopropyl alcohol, and an electrolyte, such as a salt of magnesium, zinc, aluminum, lanthanum, cerium, or yttrium. The phosphor-comprising material is typically an inorganic material with certain impurities or dopants. Examples of commonly used red, green, and blue phosphor-comprising materials are $Y_2O_3$:Eu, $Zn_2SiO_4$:Mn, and ZnS:Ag, respectively.

An exemplary solution used for electrophoretic deposition is as follows:

| Component | Weight Percent |
|---|---|
| Isopropyl Alcohol | 99.5 |
| $Mg_2(NO_3)_2$ | 0.1 |
| $Y_2O_3$:Eu | 0.4 |

An electrode is ideally immersed in a room temperature solution along with the substrate to be coated. An electric field is applied between two electrodes such that the substrate is at a negative potential relative to the other electrode. Typically, a voltage differential of 200 Volts is applied to the two electrodes for about one minute, during which time the phosphor-comprising material is deposited on the substrate. An exemplary first phosphor-comprising material is $Y_2O_3$:Eu.

Referring to FIG. 10, first patterned masking layer 26 is removed or stripped from over substrate 20 as by plasma gas, wet chemical, or thermal methods which are known. For example, polyvinyl alcohol can be stripped using an aqueous, hydrogen peroxide solution or by baking in air at 400° C. The removal of the masking layer undesirably leaves trace amounts 36 of first phosphor-comprising material 32 over the substrate in areas other than first areas 30, e.g. over second areas 34 and third areas 38. For purposes of the continuing discussion, adjacent substrate areas 30, 38 comprise first portions of the surface of the face plate over which first phosphor-comprising material is deposited. Second substrate area 34 comprises a second portion of the surface over which trace amounts of the first phosphor-comprising material are deposited.

Figure 11:
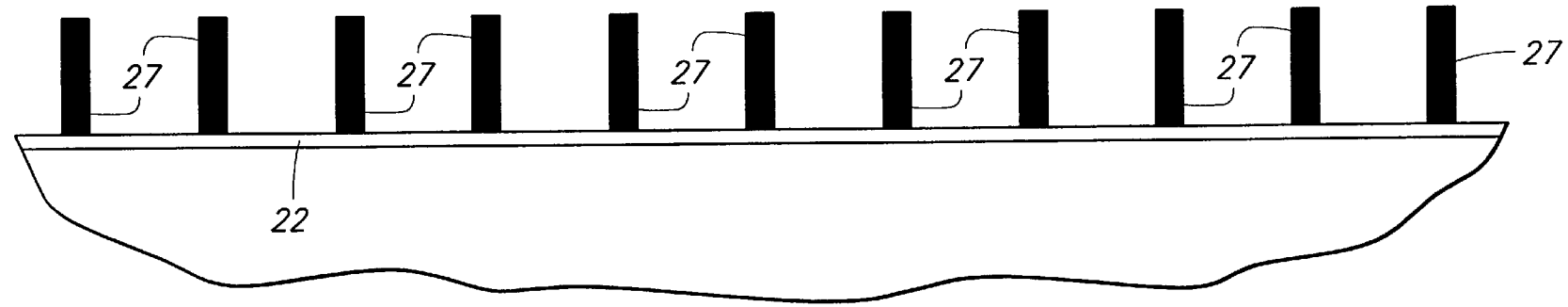
FIG. 11 is a view of the FIG. 10 substrate at a different processing step.
Figure 12:
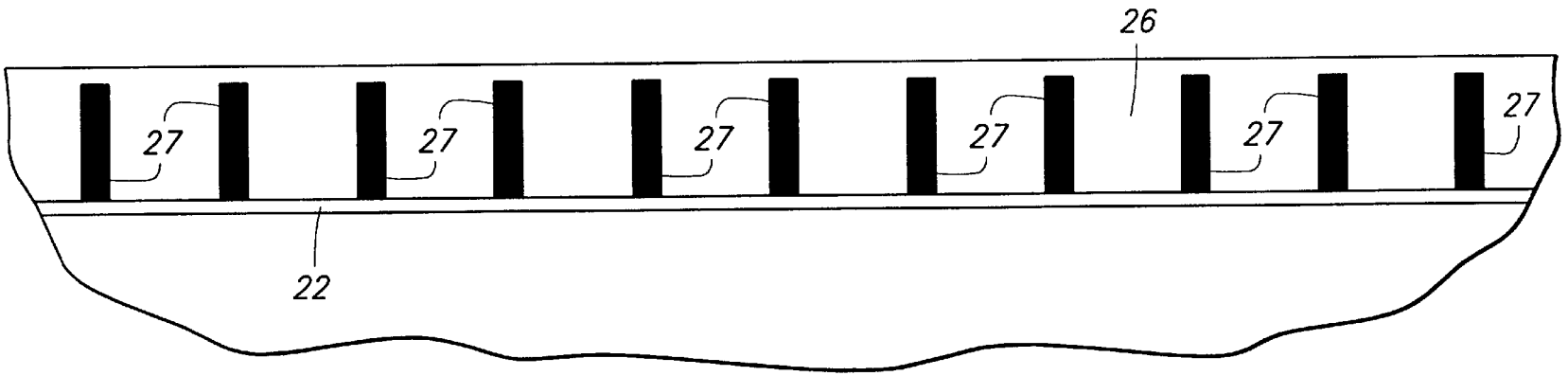
FIG. 12 is a view of the FIG. 11 substrate at a different processing step.

Referring to FIGS. 11 and 12, a second layer 40 of masking material is formed over substrate 20 and phosphor-comprising material 32, 36. In the illustrated example, second masking layer 40 comprises photoresist, with negative photoresist being preferred. Second portions of layer 40, i.e. those portions of the photoresist which are formed over the second surface portions defined by substrate areas 34, are masked while first portions of the photoresist, i.e. those portions over first areas 30 and second areas 38 are exposed to selected light or light processed as indicated by the grouped arrows. After light exposure, the mask is removed. The first and second photoresist portions are accordingly light processed differently.

Referring to FIG. 13, photoresist from over the second surface portions, e.g. second substrate areas 34, is removed with a developing solution which is effective in dislodging and removing remnant first phosphor-comprising material 36 (FIG. 12) from the substrate beneath the removed photoresist. In the illustrated and preferred embodiment, the removal of the photoresist and remnant first phosphor-comprising material takes place by exposing the substrate to a heated aqueous solution comprising a phosphor-removing material which is sufficient to outwardly expose second areas 34 through photodevelopment. Such aqueous developing solution preferably includes an acid having a concentration of less than about 10% by volume, at a temperature from between about 25° C. to 50° C. Even more preferably, the aqueous solution has a temperature from between about 35° C. to 40° C., and an acid concentration of less than about 1% by volume. A preferred acid is lactic acid, while other acids such as acetic, glycolic, phosphoric, or hydrochloric acids can be utilized. A suitable solution constituent is available from Shipley Company located at 455 Forest Street, Marlborough, Mass., and sold under the trade name "Eagle 2005 Developer" and bearing the product code 15020. The solution constituent includes the following component parts (with volume percentages being indicated parenthetically): water (24-25), lactic acid (22-23), and polyglycol (53-54). The preferred aqueous solution was formed by providing about four percent of the "Eagle 2005 Developer" by volume into about 96 percent water by volume.

In another embodiment, unexposed regions of photoresist can be treated with a suitable developing solution which is sufficient to remove the photoresist, but not trace material 36 (FIG. 12). Subsequently, to dislodge and remove the trace material over the substrate, the substrate can be further exposed to the heated aqueous solution mentioned above. The presence of an acid, preferably an organic acid, in the solution is believed to destroy the weak bonds that hold the phosphor-comprising material 36 to the substrate, thereby making it possible for the elevated temperature solution to draw the phosphor-comprising material into the bulk of the solution. The use of some inorganic acids, such as hydrochloric acid, can be equally as effective, though its use may be limited due to possible corrosive effects relative to conductive layer 22.

Other types of photoresists can be used which employ organic-based developers which do not effectively dislodge and remove the trace deposits of the phosphor-comprising material. In these instances, the use of the preferred heated, aqueous solution can effectively dislodge and remove the phosphor-comprising material 36 from the exposed substrate areas.

Use of the preferred, heated, aqueous solution can effectively remove the phosphor-comprising material 36, thereby leaving behind a clean substrate area 34 for deposition of a second color phosphor-comprising material.

Developing the photoresist as just described forms a second patterned masking layer over substrate 20 which leaves or defines a second plurality of openings 42 over second substrate areas 34. Use of the preferred solution is effective to substantially, e.g. around 95%, if not completely, remove any remnant first phosphor-comprising material from over second substrate areas 34.

Referring to FIG. 14, a second phosphor-comprising material 44 is formed over substrate 20 within openings 42 and over second areas 34. Phosphor-comprising material 44 is preferably electrophoretically deposited over second substrate areas 34. Preferred processing conditions for electrophoretically depositing phosphor-comprising material 44 are the same as those used for the first phosphor-comprising material, with an exception being that the phosphor-comprising material is different, for example, $ZnSiO_4$:Mn, green. Trace amounts 46 of phosphor-comprising material 44 can be deposited over masking layer 40.

Referring to FIG. 15, second masking layer 40 is developed or otherwise stripped from over substrate 20 as described above. Such can undesirably leave remnant second phosphor-comprising material 46 over the substrate including areas other than the second areas, particularly within third substrate areas 38 over remnant first phosphor-comprising material 36 and over areas 30. Trace deposits tend to accumulate over areas 38, where the lower topography creates regions that can trap the material.

Referring to FIG. 16, a third masking layer 48 is formed over substrate 20 and over third substrate areas 38. Third masking layer 48 preferably comprises photoresist, with negative photoresist being preferred. The photoresist is subsequently light processed (second light processed), which exposes it to radiation actinic to the particular photoresist being used. In the illustrated example, photoresist over the first portion of the substrate surface (e.g., over areas 30, 38) is light processed differently such that photoresist over areas 38 is not exposed.

Referring to FIG. 17, photoresist from over some of the first portion, e.g. area 38, is removed with a developing solution which is effective to also remove, preferably completely, remnant first and second phosphor-comprising material 36, 46 (FIG. 16) from the substrate beneath the stripped photoresist. Such is accomplished utilizing the preferred, heated aqueous solution described above comprising a phosphor-removing material which is effective to remove both first and second phosphor-comprising materials. Exemplary aqueous solutions can, and preferably do comprise those solutions described above. Removal of material of the third masking layer constitutes forming a third patterned masking layer which leaves or defines a third plurality of openings 50 over third substrate areas 38. It will be appreciated that different individual materials can have their own stripping solution.

Referring to FIG. 18, a third phosphor-comprising material 52 is formed over substrate 20 within openings 50 and over substrate areas 38. Such material can also be deposited in trace amounts over layer 48. Phosphor-comprising material 52 is preferably electrophoretically deposited over third substrate areas 38. Preferred processing conditions for electrophoretically depositing phosphor-comprising material 52 are the same as those used for the first and second phosphor-comprising materials, with an exception being that the third phosphor-comprising material comprises a different color, e.g. ZnS:Ag, blue.

Referring to FIG. 19, photoresist 48 is subsequently stripped as described above to provide the color display face plate assembly.

The above-described processing methodologies can significantly reduce the risk that trace amounts of phosphor-comprising material are deposited over areas other than those specific areas which are intended. Accordingly, displays with better color purity and uniformity are provided.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A method of forming a face plate assembly of a color display comprising:

providing a substrate comprising a portion of a face plate assembly of a color display and having a patterned masking layer thereover defining a plurality of openings over first substrate areas;

forming a phosphor-comprising material over the first substrate areas and then separately forming phosphor-comprising material over second substrate areas; and after forming the phosphor-comprising material over the second substrate areas, exposing the substrate to an aqueous solution comprising phosphor-removing material effective to remove phosphor-comprising material from over and outwardly expose the second substrate areas which are different from the first substrate areas.

2. The method of claim 1, wherein said aqueous solution is heated to a temperature from between about 25 °C. to 50 °C.

3. The method of claim 1, wherein said aqueous solution comprises less than about ten percent of an organic acid by volume.

4. The method of claim 3, wherein said aqueous solution comprises less than about ten percent of an organic acid by volume.

5. The method of claim 1 further comprising prior to exposing said substrate to said aqueous solution, forming a second masking layer over said substrate and over the phosphor-comprising material over the second substrate areas, wherein said aqueous solution is effective to remove portions of said second masking layer from over said second substrate areas.

6. The method of claim 5, wherein said second masking layer comprises negative photoresist and further comprising prior to said exposing, light processing photoresist other than those portions which are removed from over said second substrate areas.

7. The method of claim 5, wherein said aqueous solution comprises less than about ten percent of an organic acid by volume.

8. The method of claim 5 further comprising forming a second phosphor-comprising material over said second substrate areas and then separately forming second phosphor-comprising material over third substrate areas and thereafter, exposing said substrate to an aqueous solution comprising phosphor-removing material effective to remove second phosphor-comprising material from over and outwardly expose the third substrate areas which are different from the second substrate areas.

9. The method of claim 8 further comprising:

prior to exposing said third substrate areas, forming a third masking layer over said substrate and over the second phosphor-comprising material over the third substrate areas;

wherein said aqueous solution which is effective to remove second phosphor-comprising material is also effective to remove portions of said third masking layer from over said third substrate areas; and after said exposing of said third substrate areas, forming a third phosphor-comprising material over said third substrate areas.

10. A method of forming a face plate assembly of a color display comprising:

forming a first phosphor-comprising material over a surface of the face plate;

forming negative photoresist over the first phosphor-comprising material;

masking first portions of the negative photoresist while leaving second portions exposed;

exposing the second portions to selected light;

after the exposing, removing the mask;

after removing the mask, exposing the negative photoresist to a solution comprising aqueous organic acid that strips the non-light-exposed photoresist and first phosphor-comprising material therebeneath from over the face plate surface; and after stripping the non-light-exposed photoresist and first phosphor-comprising material therebeneath, forming second phosphor-comprising material at least over the surface of the face plate from which the non-light-exposed photoresist and first phosphor-comprising material was stripped.

11. The method of claim 10, wherein said organic acid comprises lactic acid.

12. The method of claim 10, wherein said organic acid comprises lactic acid having a concentration of less than about ten percent by volume.

13. A method of forming a face plate assembly of a color display comprising:

providing a substrate having a first patterned masking layer defining a first plurality of openings over first substrate areas, the substrate comprising a portion of a face plate assembly of a color display;

forming a first phosphor-comprising material over the first substrate areas;

removing the first patterned masking layer and leaving a remnant of the first phosphor-comprising material over second and third substrate areas;

forming a second patterned masking layer over the substrate defining a second plurality of openings over the second substrate areas which are different from the first substrate areas, said forming of the second patterned masking layer comprising exposing the substrate to a phosphor-removing solution which is effective to remove at least some of the remnant first phosphor-comprising material from within the second openings over said second substrate areas; and forming a second phosphor-comprising material over the second substrate areas.

14. The method of claim 13, wherein said phosphor-removing solution comprises an aqueous organic acid solution.

15. The method of claim 14, wherein said solution comprises a concentration of less than about ten percent lactic acid by volume.

16. The method of claim 13 further comprising:

forming a third patterned masking layer over the substrate defining a third plurality of openings over the third substrate areas which are different from said second substrate areas, said forming of said third patterned masking layer comprising exposing said substrate to a phosphor-removing solution which is effective to remove at least some of the remnant first phosphor-comprising material and a remnant second phosphor-comprising material from within the third openings over said third substrate areas; and forming a third phosphor-comprising material over said third substrate areas.

17. The method of claim 16, wherein both of said phosphor-removing solutions comprise aqueous organic acid solutions having a concentration of less than about ten percent organic acid by volume.

18. The method of claim 17, wherein the organic acid in one of said solutions comprises lactic acid.

19. A method of forming a face plate assembly of a color display comprising:

providing a substrate having a first patterned masking layer defining a first plurality of openings over first substrate areas, the substrate comprising a portion of a face plate assembly of a color display and comprising second substrate areas;

forming a first phosphor-comprising material within the first openings over the first substrate areas and over the first patterned masking layer over the second substrate areas;

removing the first patterned masking layer and leaving some first phosphor-comprising material over the substrate in the second substrate areas;

forming a second patterned masking layer comprising photoresist over the substrate leaving a second plurality of openings over the second substrate areas, said forming of the second patterned masking layer comprising exposing the substrate to a photoresist-developing solution which is effective to substantially remove second masking layer material and the first phosphor-comprising material from over said second substrate areas; and forming a second phosphor-comprising material over the second substrate areas.

20. The method of claim 19, wherein said photoresist-developing solution comprises an aqueous organic acid solution.

21. The method of claim 20, wherein said photoresist-developing solution comprises a concentration of less than about ten percent lactic acid by volume.

22. The method of claim 20, wherein said photoresist-developing solution comprises a concentration of less then about ten percent acetic acid by volume.

23. The method of claim 19 further comprising:

removing said second patterned masking layer and leaving some second phosphor-comprising material over the substrate in third substrate areas;

forming a third patterned masking layer comprising photoresist over said substrate leaving a third plurality of openings over said third substrate areas, said forming of said third patterned masking layer comprising exposing the substrate to a photoresist-developing solution which is effective to substantially remove third masking layer material and first and second phosphor-comprising material from over said third substrate areas; and forming a third phosphor-comprising material within said third openings over said third substrate areas.

24. The method of claim 23, wherein both of said developing solutions comprise aqueous organic acid solutions.

25. The method of claim 24, wherein one of the solutions comprises a concentration of lactic acid of less then about ten percent by volume.

* * * * *

UNITED STATES PATENT AND TRADEMARK OFFICE

CERTIFICATE OF CORRECTION

PATENT NO. : 6,458,260 B2
DATED : October 1, 2002
INVENTOR(S) : Jefferson O. Nemelka It is certified that error appears in the above-identified patent and that said Letters Patent is hereby corrected as shown below:

Column 1,
Line 7, replace "of" with -- on --
Line 11, insert:
-- GOVERNMENT RIGHTS This invention was made with United States Government support under contract No. DABT63-93-C-0025 awarded by the Advanced Research Projects Agency (ARPA). The United States Government has certain rights in this invention. --

Column 4,
Line 46, replace "first areas 30 and second areas 38" with
-- substrate areas 30, 38 --

Column 7,
Line 10, replace claim 4
"The method of claim 3, wherein said aqueous solution comprises less than about ten percent of an organic acid by volume."
with
-- The method of claim 3, wherein said organic acid comprises lactic acid. --

Signed and Sealed this

Tenth Day of June, 2003

JAMES E. ROGAN
*Director of the United States Patent and Trademark Office*